US010792920B2

(12) United States Patent
Iwata et al.

(10) Patent No.: US 10,792,920 B2
(45) Date of Patent: Oct. 6, 2020

(54) LAMINATED SUBSTRATE, LIQUID DISCHARGE HEAD, AND LIQUID DISCHARGE APPARATUS

(71) Applicants: Junichi Iwata, Kanagawa (JP); Yoshitaka Fujinuma, Ibaraki (JP); Kanshi Abe, Ibaraki (JP); Takayuki Nakai, Kanagawa (JP); Koji Kawahara, Ibaraki (JP)

(72) Inventors: Junichi Iwata, Kanagawa (JP); Yoshitaka Fujinuma, Ibaraki (JP); Kanshi Abe, Ibaraki (JP); Takayuki Nakai, Kanagawa (JP); Koji Kawahara, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/415,216

(22) Filed: May 17, 2019

(65) Prior Publication Data

US 2019/0358953 A1 Nov. 28, 2019

(30) Foreign Application Priority Data

May 25, 2018 (JP) ..... 2018-101011
Jan. 30, 2019 (JP) ..... 2019-014508

(51) Int. Cl.
*B41J 2/14* (2006.01)

(52) U.S. Cl.
CPC ..... *B41J 2/14233* (2013.01); *B41J 2/14274* (2013.01); *B41J 2002/14419* (2013.01)

(58) Field of Classification Search
CPC ..... B41J 2/14233; B41J 2/14274; B41J 2002/14419
See application file for complete search history.

(56) References Cited

U.S. PATENT DOCUMENTS

| | | | | |
|---|---|---|---|---|
| 2003/0067513 | A1 | 4/2003 | Eguchi et al. | |
| 2007/0080978 | A1 | 4/2007 | Yoshida | |
| 2009/0147034 | A1 | 6/2009 | Yoshida | |
| 2009/0289975 | A1 | 11/2009 | Yoshida | |
| 2011/0096113 | A1 | 4/2011 | Yoshida | |
| 2012/0236080 | A1 | 9/2012 | Yoshida et al. | |
| 2014/0210914 | A1 | 7/2014 | Yoshida et al. | |
| 2015/0077469 | A1* | 3/2015 | Kohda | B41J 2/055 347/40 |
| 2015/0246536 | A1 | 9/2015 | Yoshida | |

(Continued)

FOREIGN PATENT DOCUMENTS

| | | |
|---|---|---|
| JP | 10-100402 | 4/1998 |
| JP | 2003-019793 | 1/2003 |

(Continued)

*Primary Examiner* — Geoffrey S Mruk
(74) *Attorney, Agent, or Firm* — Oblon, McClelland, Maier & Neustadt, L.L.P.

(57) ABSTRACT

A liquid discharge head includes a plurality of nozzles arrayed in a nozzle array direction to discharge a liquid; a plurality of pressure chambers arrayed in the nozzle array direction and communicating with the plurality of nozzles, respectively; and a diaphragm forming a displaceable wall of each of the plurality of pressure chambers. The diaphragm includes a concave portion outside an arrangement region of the plurality of pressure chambers in which the plurality of pressure chambers is arrayed in the nozzle array direction.

8 Claims, 17 Drawing Sheets

(56) References Cited

U.S. PATENT DOCUMENTS

| | | | |
|---|---|---|---|
| 2016/0082728 | A1 | 3/2016 | Kohda et al. |
| 2016/0096369 | A1 | 4/2016 | Shimizu et al. |
| 2016/0129691 | A1 | 5/2016 | Yoshida |
| 2016/0185113 | A1 | 6/2016 | Yoshida et al. |
| 2016/0297193 | A1 | 10/2016 | Yoshida |
| 2017/0087865 | A1 | 3/2017 | Yoshida et al. |
| 2017/0096015 | A1 | 4/2017 | Odaka et al. |
| 2017/0120602 | A1 | 5/2017 | Nakai et al. |
| 2017/0157924 | A1 | 6/2017 | Otome et al. |
| 2017/0232741 | A1 | 8/2017 | Kikuchi et al. |
| 2017/0239949 | A1 | 8/2017 | Yoshida |
| 2017/0253062 | A1 | 9/2017 | Murakami et al. |
| 2017/0297333 | A1 | 10/2017 | Kohda et al. |
| 2018/0194135 | A1 | 7/2018 | Iwama et al. |
| 2018/0257374 | A1 | 9/2018 | Yoshida et al. |
| 2018/0272709 | A1 | 9/2018 | Iwata et al. |
| 2018/0272730 | A1 | 9/2018 | Odaka et al. |
| 2018/0272740 | A1 | 9/2018 | Otome et al. |
| 2018/0272743 | A1 | 9/2018 | Nakai et al. |

FOREIGN PATENT DOCUMENTS

| | | |
|---|---|---|
| JP | 2003-019794 | 1/2003 |
| JP | 2004-106356 | 4/2004 |
| JP | 2012-179813 | 9/2012 |

* cited by examiner

LAMINATED SUBSTRATE, LIQUID DISCHARGE HEAD, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-101011, filed on May 25, 2018, and Japanese Patent Application No. 2019-014508, filed on Jan. 30, 2019, in the Japan Patent Office, the entire disclosure of each of which is hereby incorporated by reference herein.

BACKGROUND

Technical Field

The present disclosure relates to a liquid discharge head, a liquid discharge device, and a liquid discharge apparatus.

Related Art

A liquid discharge head, for example, includes one or a plurality of concave portions formed along a nozzle array direction on a diaphragm forming a deformable wall (vibration portion) of a pressure chamber (individual chamber) communicating with a nozzle. The concave portion forms a thin wall serving as a damper.

A dummy island portion may also be formed in a region of the diaphragm other than a region of the diaphragm in which an island portion is formed. The island portion is a deformable wall in the diaphragm to which the piezoelectric element is bonded. The dummy island portion stabilizes a thickness of the diaphragm when the diaphragm is formed by electroformation.

SUMMARY

In one aspect of this disclosure, a novel liquid discharge head includes a plurality of nozzles arrayed in a nozzle array direction to discharge a liquid, a plurality of pressure chambers arrayed in the nozzle array direction and communicating with the plurality of nozzles, respectively, and a diaphragm forming a displaceable wall of each of the plurality of pressure chambers. The diaphragm includes a concave portion outside an arrangement region of the plurality of pressure chambers in which the plurality of pressure chambers is arrayed in the nozzle array direction.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
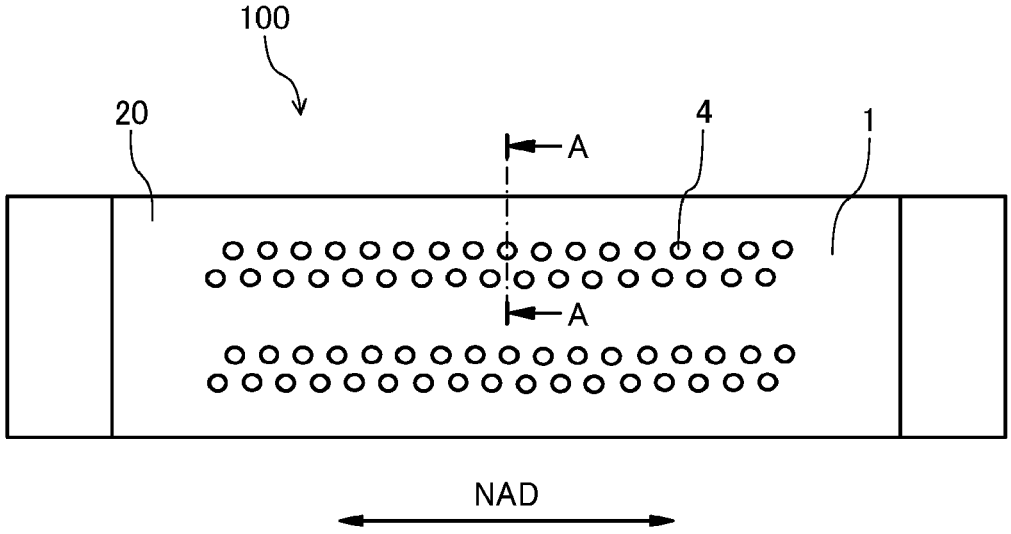
FIG. 1 is a plan view of the liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

Embodiments of the present disclosure are described below with reference to the attached drawings.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

A first embodiment of the present disclosure is described with reference to FIGS. 1 to 4.

Figure 2:
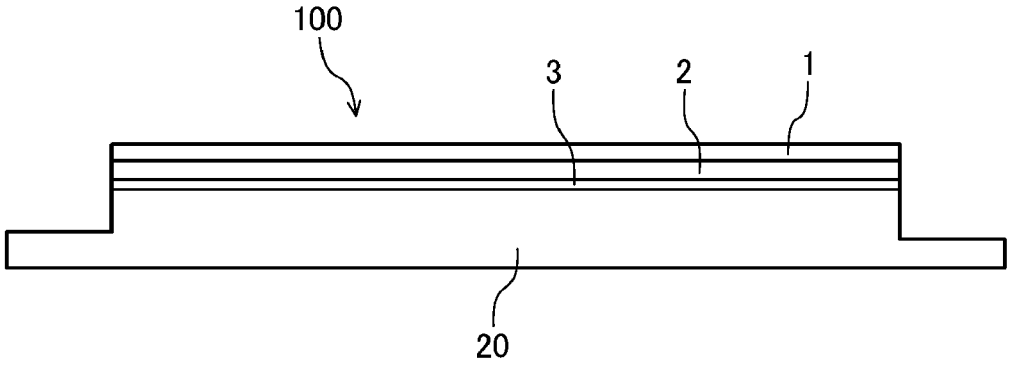
FIG. 2 is a side view of the liquid discharge head of FIG. 1.
Figure 3:
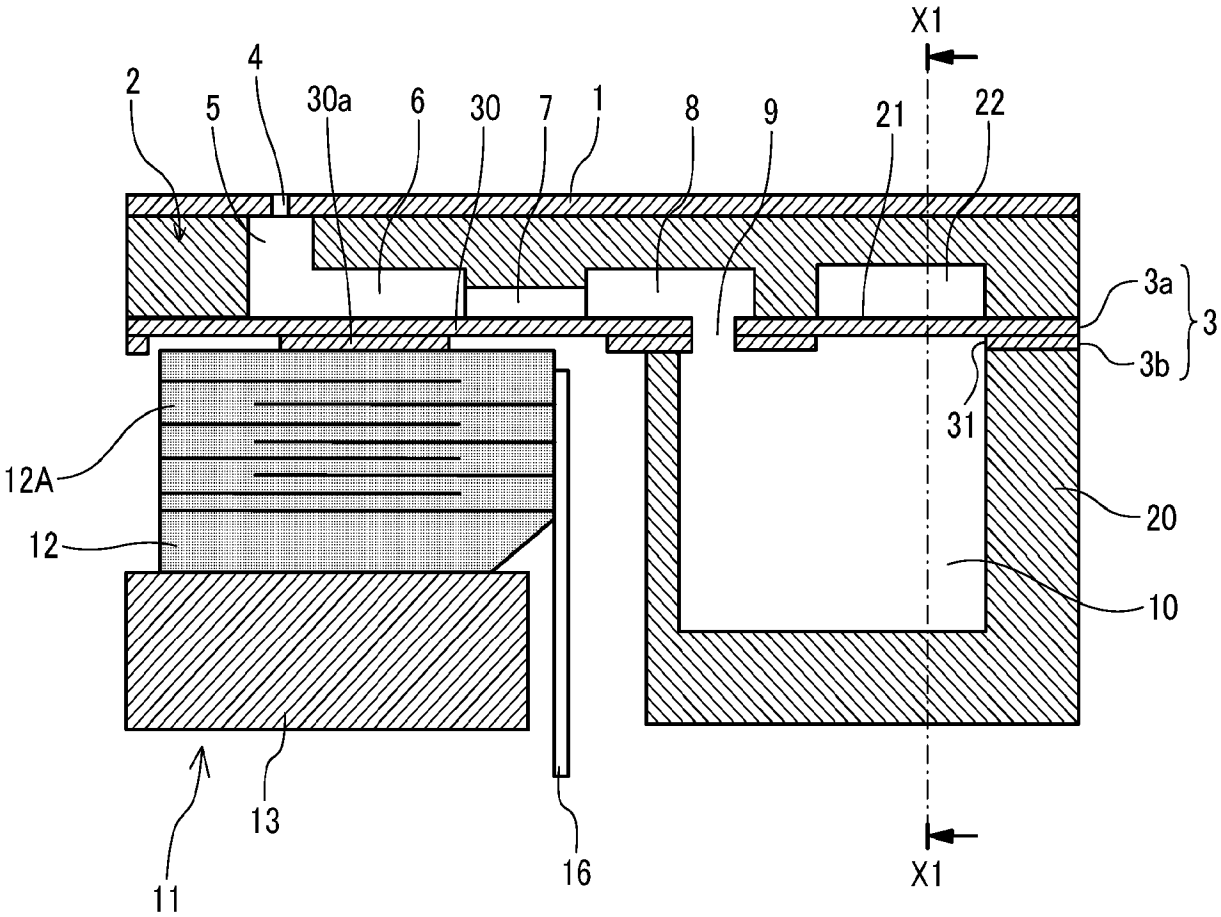
FIG. 3 is a cross-sectional view of the liquid discharge head along a line A-A indicated in FIG. 1 in a direction perpendicular to a nozzle array direction in which nozzles are arrayed in row.
Figure 4:
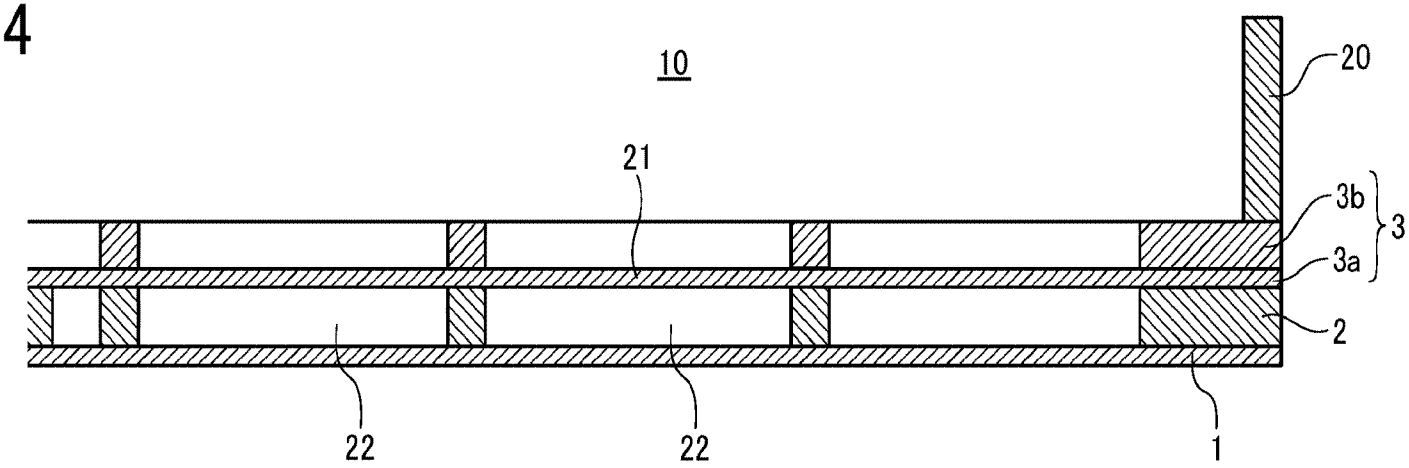
FIG. 4 is a schematic cross-sectional view along the nozzle array direction corresponding to a line X1-X1 in FIG. 3.

FIG. 1 is a plan view of a liquid discharge head according to the first embodiment of the present disclosure. FIG. 2 is a side view of the liquid discharge head according to the first embodiment of the present disclosure. FIG. 3 is a cross-sectional view of the liquid discharge head along a line A-A indicated in FIG. 1 in a direction perpendicular to a nozzle array direction in which nozzles are arrayed in row. The nozzle array direction (NAD) is indicated by arrow "NAD" in FIG. 1. FIG. 4 is a schematic cross-sectional view along the nozzle array direction NAD corresponding to the line X1-X1 in FIG. 3.

The liquid discharge head 100 includes a nozzle plate 1, a channel plate 2, and a diaphragm 3 as a wall member. The nozzle plate 1, the channel plate 2, and the diaphragm 3 are laminated and bonded. Hereinafter, the "liquid discharge head" is simply referred to as the "head". The head 100 further includes a piezoelectric actuator 11 to displace vibration portions 30 of the diaphragm 3 and a common-chamber member 20 also serving as a frame of the head 100.

As illustrated in FIG. 1, the nozzle plate 1 includes two rows of nozzle arrays in each of which the nozzles 4 are arranged. The liquid is discharged from the nozzles 4.

The channel plate 2 includes through-holes and grooves that constitute nozzle communication channels 5 communicated with the nozzles 4, pressure chambers 6 communicated with the nozzles 4 via the nozzle communication channels 5, fluid restrictors 7 communicated with the pressure chambers 6, respectively, and one or more liquid introduction portion 8 communicated with the fluid restrictors 7. Each of the pressure chambers 6 functions as an individual chamber.

The diaphragm 3 includes a plurality of displaceable vibration portions 30 of the diaphragms 3 forming a wall of the pressure chamber 6 (individual chamber) of the channel plate 2. In the present disclosure, the diaphragm 3 has a two-layer structure (although not limited to two but three or more) and is composed of a first layer 3*a* forming a thin portion from the channel plate 2 side and a second layer 3*b* forming a thick portion. In the diaphragm 3, the first layer 3*a* includes the displaceable (deformable) vibration portions 30 positioned corresponding to the pressure chambers 6.

The piezoelectric actuator 11 includes electromechanical transducer elements as driving devices (actuator devices or pressure generators) to deform the vibration portions 30 of the diaphragm 3. The piezoelectric actuator 11 is disposed at a first side of the diaphragm 3 opposite a second side facing the pressure chambers 6 (see FIG. 3).

The piezoelectric actuator 11 includes piezoelectric members 12 bonded on a base 13. The piezoelectric members 12 are groove-processed by half-cut dicing so that each piezoelectric member 12 includes a desired number of pillar-shaped piezoelectric elements 12A at certain intervals to assume a comb-like shape.

The piezoelectric element 12A is joined to the convex portion 30*a*, which is an island-shaped thick portion on the vibration portion 30 of the diaphragm 3.

A piezoelectric layer and an internal electrode, alternately stacked, form the piezoelectric member 12. Each internal electrode extends to an end face of the piezoelectric member 12 and connected to an external electrode (end surface electrode), and the flexible wiring member 16 is connected to the external electrode.

The common-chamber member 20 forms a common chamber 10. The common chamber 10 communicates with the liquid introduction portion 8 via an opening 9 provided in the diaphragm 3.

Further, the diaphragm 3 includes a concave portion 31 opposing the common chamber 10. The first layer 3*a* forms a damper 21 that becomes a deformable wall of the common chamber 10. A damper chamber 22 (gas chamber) is formed in the channel plate 2 on a side of the damper 21 opposite to the common chamber 10. A through-hole of the channel plate 2 formed between the nozzle plate 1 and the diaphragm 3 forms the damper chamber 22.

In the head 100, for example, when the voltage applied to the piezoelectric element 12A is lowered from a reference potential (intermediate potential), the piezoelectric element 12A contracts. As a result, the vibration portion 30 of the diaphragm 3 is pulled and the volume of the pressure chambers 6 increases, thus causing liquid to flow into the pressure chambers 6.

When the voltage applied to the piezoelectric element 12A is raised, the piezoelectric element 12A expands in a direction of lamination of the piezoelectric element 12A. The vibration portion 30 of the diaphragm 3 deforms in a direction toward the nozzle 4 and contracts the volume of the pressure chambers 6. As a result, the liquid in the pressure chambers 6 is squeezed out of the nozzle 4.

Note that the driving method of the head 100 is not limited to the above-described example (pull-push discharge). For example, pull discharge or push discharge may be performed in response to the way the drive waveform is applied to the piezoelectric element 12A.

Figure 5:
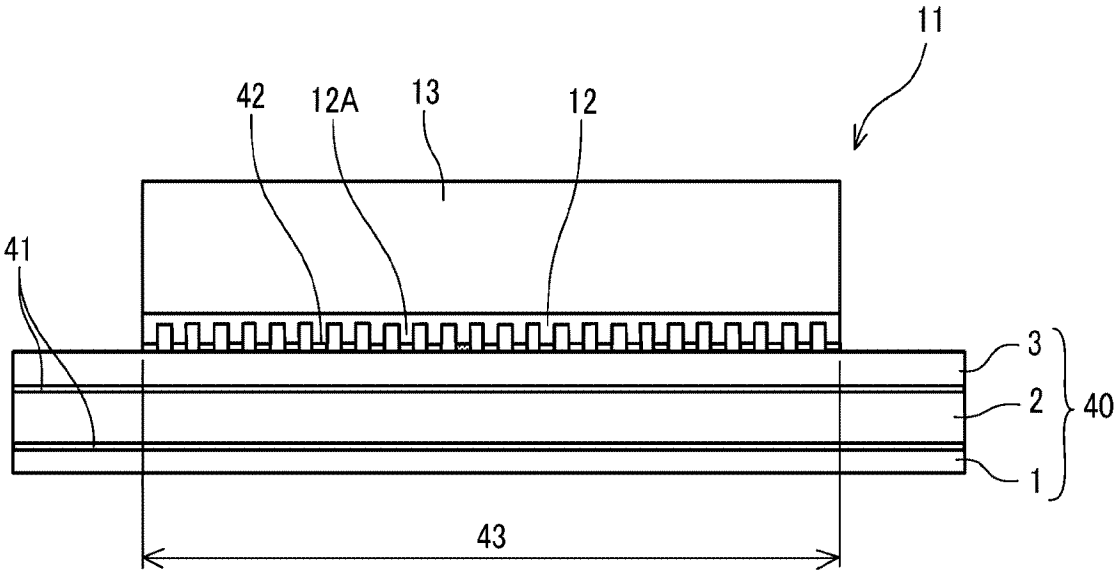
FIG. 5 is a cross-sectional view of the liquid discharge head illustrating a bonding structure of a channel unit and a piezoelectric actuator.

Next, a bonding structure of the channel unit 40 and the piezoelectric actuator 11 in a longitudinal direction of the channel unit 40 is described with reference to FIG. 5. FIG. 5 is a cross-sectional view of the head 100 illustrating a bonding structure of the channel unit 40 and the piezoelectric actuator 11.

The nozzle plate 1 and the channel plate 2, and the channel plate 2 and the diaphragm 3, are respectively bonded together with an adhesive 41 to form the channel unit 40. Since the adhesive 41 is uniformly applied in a very thin layer, a thickness of the channel unit 40 is almost the same as the combined thickness of the nozzle plate 1, the channel plate 2, and the diaphragm 3.

The piezoelectric element 12A of the piezoelectric actuator 11 is bonded to the vibration portion 30 of the diaphragm 3 with an adhesive 42. From a viewpoint of bonding reliability, the channel unit 40 has to be flat in a bonding range 43 of the piezoelectric actuator 11.

In the head 100 according to the present disclosure, the bonding range 43 of the piezoelectric actuator 11 is a range from 1 cm to 6.5 cm from one end of the channel unit 40 with respect to a total length of about 7.5 cm in a longitudinal direction (nozzle array direction) of the channel unit 40.

Figure 6:
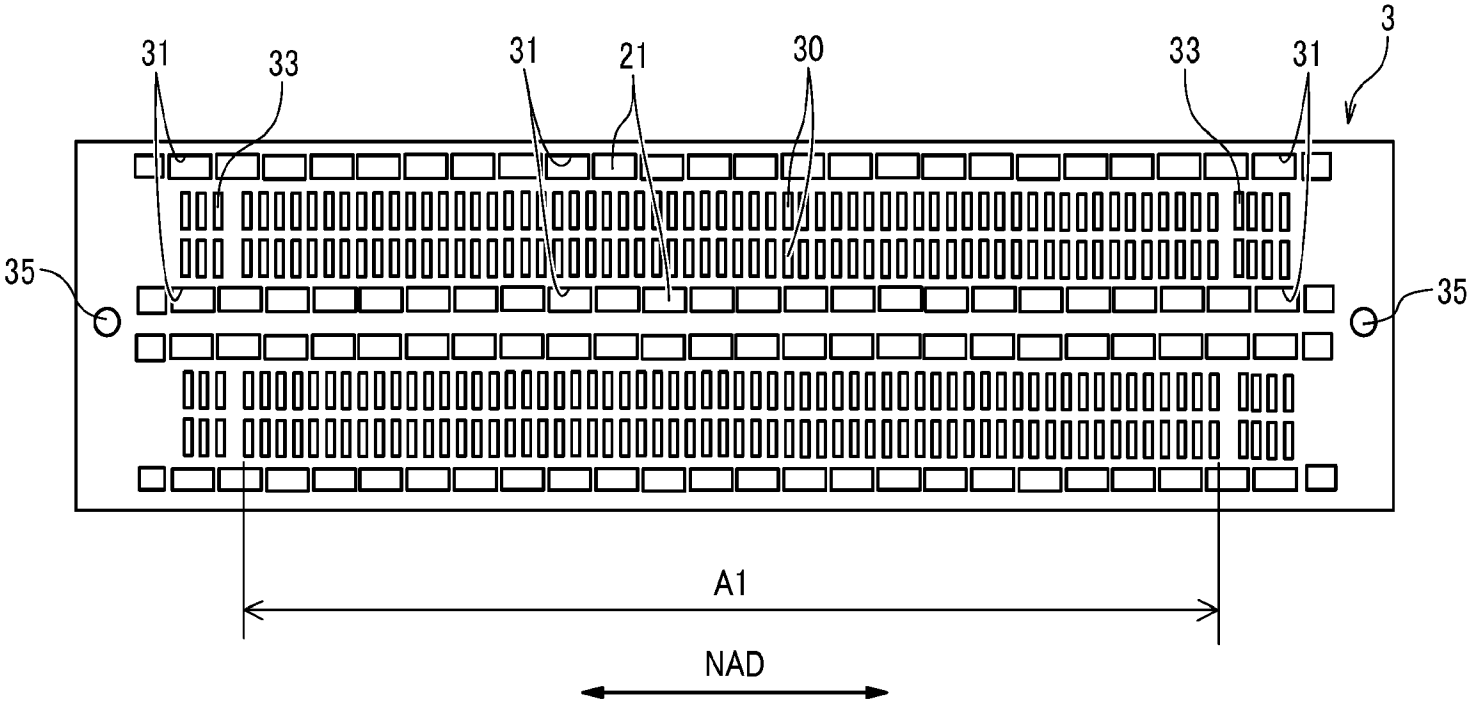
FIG. 6 is a plan view of a diaphragm.

Next, the diaphragm 3 is described with reference to FIG. 6. FIG. 6 is a plan view of the diaphragm 3.

A plurality of vibration portions 30 are arranged in an arrangement region A1 along the nozzle array direction in the diaphragm 3. The head 100 according to the present disclosure includes a plurality of dummy vibration portions 33. The dummy vibration portions 33 are formed outside the arrangement region A1 in an array direction of the pressure chambers 6. The array direction of the pressure chamber 6 is parallel to an array direction of the vibration portions 30 and also the nozzle array direction NAD. The arrangement region A1 is a region in which a plurality of pressure chambers 6 is arranged.

Further, the diaphragm 3 includes a plurality of concave portions 31 formed by a thin-wall (first layer 3*a*) parallel to the array direction of the pressure chambers 6 in the diaphragm 3. The plurality of concave portions 31 forms the plurality of dampers 21, respectively. The diaphragm 3 of the head 100 according to the present disclosure includes the concave portions 31 also outside the region A1, in which the plurality of pressure chambers 6 are formed, in the array direction of the pressure chambers 6.

Thus, the concave portion 31 arranged outside the region A1, in which the plurality of pressure chambers 6 are formed, is located inside an alignment mark 35 in the array direction of the pressure chambers 6. The alignment mark 35 is used when the diaphragm 3 is bonded to the channel plate 2. The diaphragm 3 includes the alignment marks 35 in each end of the diaphragm 3 in the array direction of the pressure chambers 6 (see FIG. 9).

Figure 7:
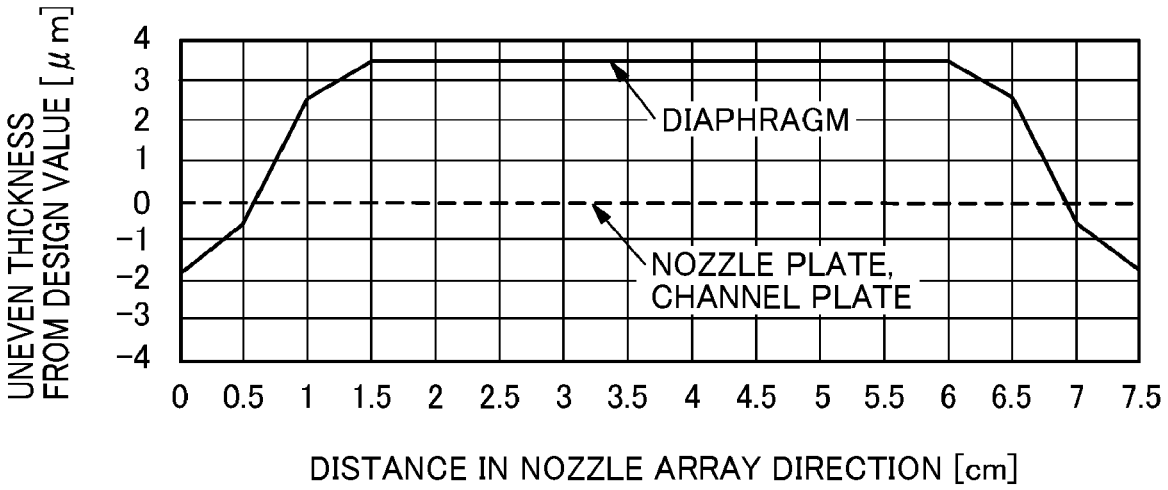
FIG. 7 is a graph of an example of an uneven thickness of the diaphragm in the nozzle array direction.
Figure 8:
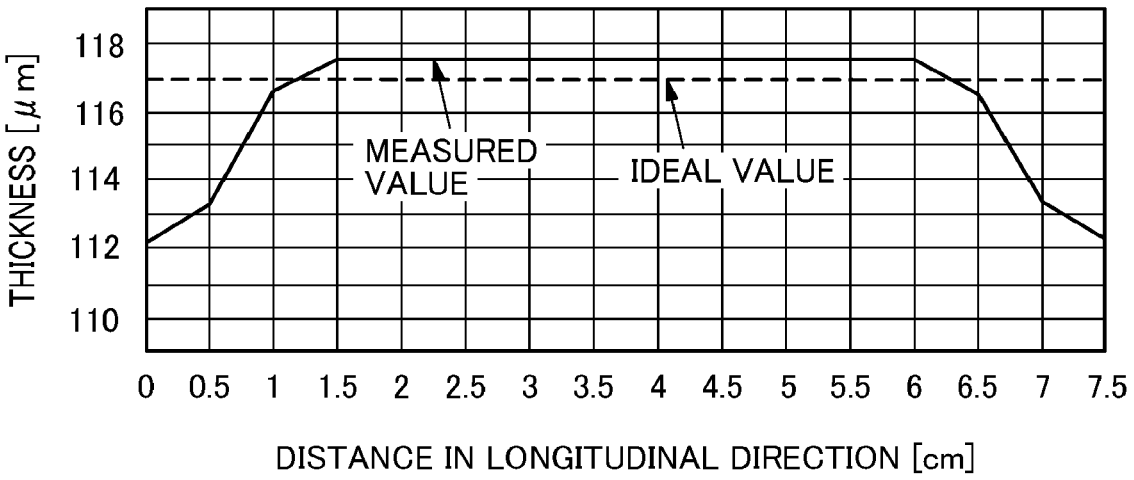
FIG. 8 is a graph of an example of an uneven thickness of the channel unit in the nozzle array direction.

Next, an example of uneven thickness in the nozzle array direction NAD of the diaphragm 3 and the channel unit 40 according to the preset disclosure is described with reference to FIGS. 7 and 8. FIG. 7 is a graph of an example of an uneven thickness of the diaphragm 3 in the nozzle array direction NAD. FIG. 8 is a graph of an example of an uneven thickness of the channel unit 40 in the nozzle array direction NAD. The nozzle array direction NAD is parallel to the longitudinal direction of the channel unit 40.

If the diaphragm 3 is manufactured by electroformation plating, the first layer 3*a* is film-formed first in the present disclosure. Then, a non-conductive resist pattern is formed to film-form the second layer 3*b* in a region other than the concave portion 31 that becomes the damper 21 and the convex portion 30*a* of the vibration portion 30.

When the nonconductive resist pattern is formed to perform plating by electroformation as described above, an electric field at a shielding area of the resist pattern concentrates at an electrode portion of an end of the resist pattern with an increase of the shielding area of the resist pattern. Thus, a film thickness of plating tends to increase.

In the present disclosure, the concave portion 31 forming the damper 21 has a larger shielding area by a resist than a shielding area of the vibration portion 30. Thus, the film thickness of plating around the concave portion 31 that forms the damper 21 becomes thicker than other patterns.

Thus, the head 100 in the present disclosure includes the concave portion 31 also arranged outside the arrangement region A1 in which the pressure chambers 6 are arranged.

Thus, the arrangement region A1 of the pressure chamber 6 of the diaphragm 3 bonded to the piezoelectric actuator 11 can be made substantially flat. The arrangement region A1 is a bonding range 43 with the piezoelectric actuator 11.

Specifically, as illustrated in FIG. 7, a thickness of the diaphragm 3 is thinner than a design value at both ends of the diaphragm 3 and thicker than the designed value at the center of the diaphragm 3. The thickness of the diaphragm 3 within the arrangement region A1 of the pressure chamber 6 from 1 cm to 6.5 cm from one end of the diaphragm 3 (corresponding to the bonding range 43 of the piezoelectric actuator 11) is substantially flat.

When the diaphragm 3, the flat nozzle plate 1, and the channel plate 2 are used to form the channel unit 40 (see FIG. 5), a measured value of the thickness of the channel unit 40 approaches an ideal value of a total thickness within the arrangement region A1 of the pressure chamber 6 from 1 cm to 6.5 cm from one end of the channel unit 40.

Thus, the head 100 can ensure a flatness of the diaphragm 3 within the bonding range 43 when the piezoelectric element 12A of the piezoelectric actuator 11 and each of the vibration portions 30 of the diaphragm 3 are bonded with the adhesive 42. Thus, the head 100 can improve reliability of bonding between the piezoelectric element 12A of the piezoelectric actuator 11 and each of the vibration portions 30 of the diaphragm 3.

Figure 9:
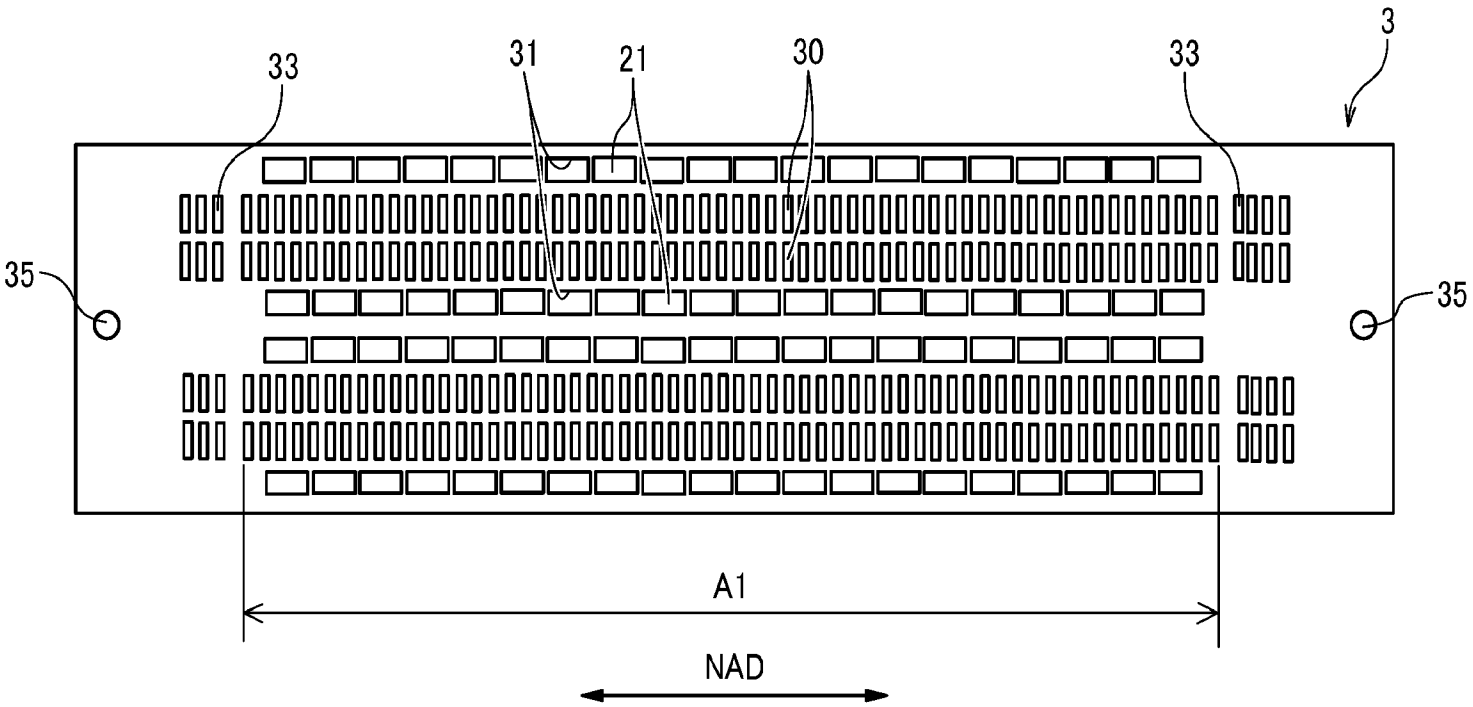
FIG. 9 is a plan view of a diaphragm of the comparative example 1.
Figure 10:
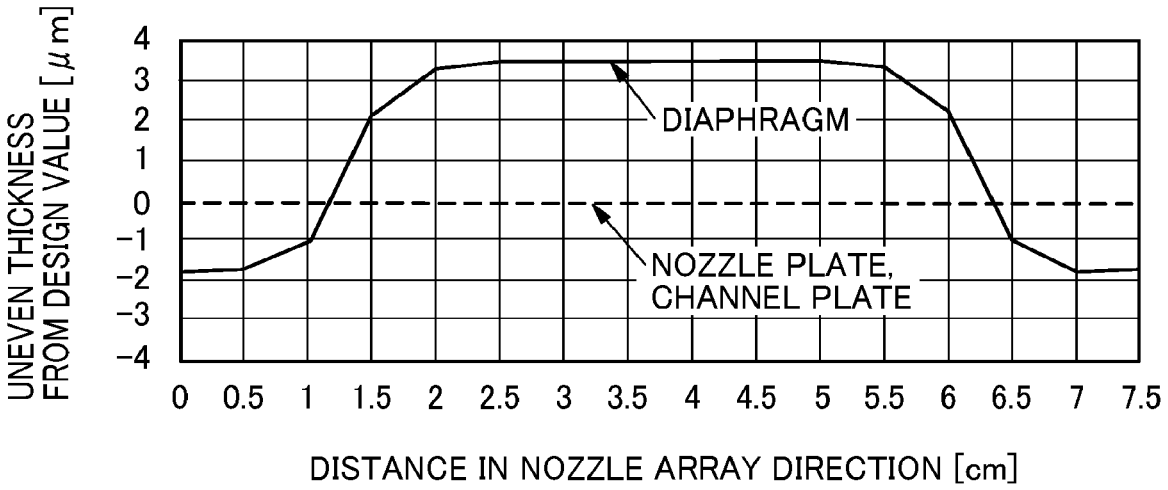
FIG. 10 is a graph of an uneven thickness of the diaphragm in the nozzle array direction of the comparative example 1.
Figure 11:
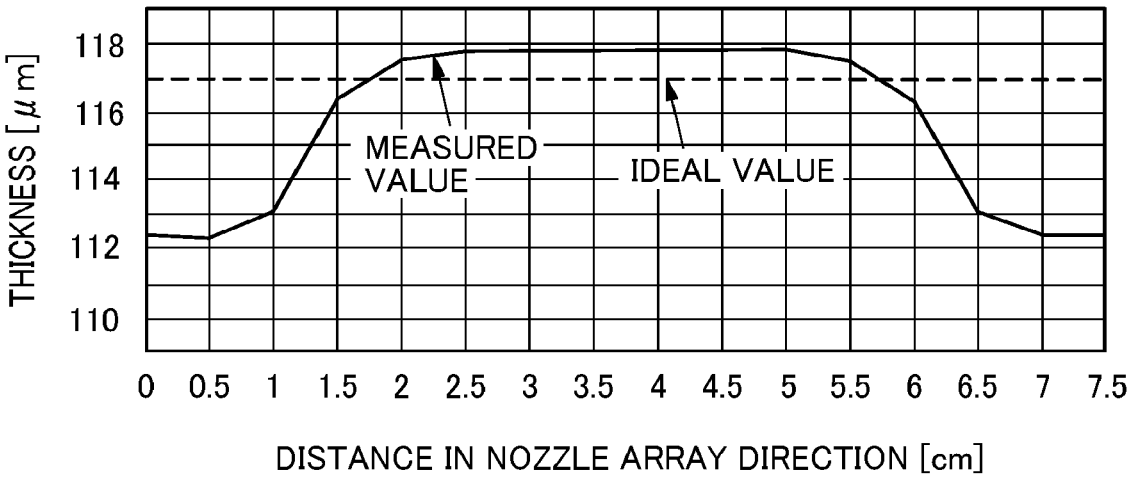
FIG. 11 is a graph of an uneven thickness of the channel unit in the nozzle array direction of the comparative example 1.

A comparative example is described below with reference to FIGS. 9 to 11. FIG. 9 is a plan view of a diaphragm of the comparative example. FIG. 10 is a graph of an uneven thickness of the diaphragm 3 in the nozzle array direction NAD of the comparative example. FIG. 11 is a graph of an uneven thickness of the channel unit 40 in the nozzle array direction NAD of the comparative example.

In the comparative example 1, the concave portions 31 are arranged only inside the arrangement region A1 of the pressure chamber 6 in the array direction of the pressure chambers 6, and the concave portion 31 is not arranged outside the arrangement region A1.

As illustrated in FIG. 10, the diaphragm 3 of the comparative example 1 is thinner than the design value at both ends of the diaphragm 3 and thicker than the design value at a center of the diaphragm 3. Since the diaphragm 3 of the comparative example 1 does not includes the concave portion 31 outside the arrangement region A1, the diaphragm is flat only in the range from 2 cm to 4.5 cm from one end of the diaphragm 3.

Thus, when the diaphragm 3 of the comparative example, the flat nozzle plate 1, and the channel plate 2 are used to form the channel unit 40, the thickness of the channel unit 40 approaches an ideal value of a total thickness only within a range from 2 cm to 5.5 cm from one end of the channel unit 40.

Thus, the comparative example cannot ensure a flatness of the diaphragm 3 at each end of the bonding range 43 when the piezoelectric element 12A of the piezoelectric actuator 11 and each of the vibration portions 30 of the diaphragm 3 are bonded with the adhesive 42. Thus, failure of bonding between the piezoelectric element 12A and each vibration portions 30 may occur.

Conversely, the head 100 in the present disclosure includes the concave portions 31 outside the arrangement region A1 of the pressure chamber 6. Thus, when the diaphragm 3 is manufactured by electroformation, the thickness of the diaphragm 3 is controlled to reduce the uneven thickness of the diaphragm 3 alone and to improve flatness of the channel unit 40 within the bonding range 43 between the piezoelectric actuator 11 and the diaphragm 3.

When the thin portion (a portion of the first layer 3*a* in the above-described embodiments) by the concave portion 31 arranged outside the arrangement region A1 of the pressure chamber 6 faces the common chamber 10, the thin portion by the concave portion 31 becomes the damper 21. However, when the thin portion does not face the common chamber 10, the thin portion is merely a thin portion and does not become the damper 21.

Thus, the concave portion 31 does not have to form the damper 21 including the concave portion 31 arranged in the arrangement region A1 of the pressure chamber 6. The concave portion 31 may be a concave portion that only controls the thickness of the diaphragm 3.

Further, as described above, the concave portions 31 are disposed inside the alignment mark 35 in the present disclosure. Thus, the head 100 according to the present disclosure can isolate the impact of a thickness of the diaphragm 3 due to formation of the concave portion 31 on the alignment mark 35, such as a change in diameter of a hole of the alignment mark 35.

Figure 12:
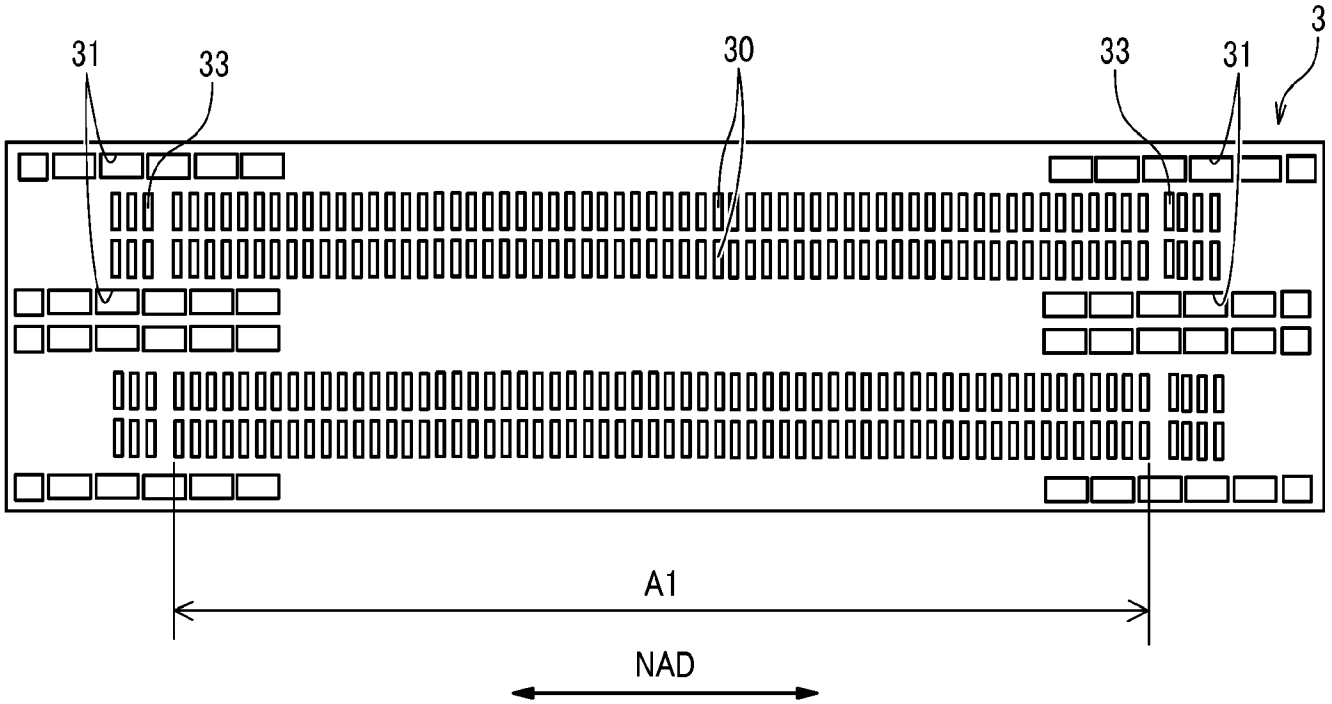
FIG. 12 is a plan view of the diaphragm according to a second embodiment of the present disclosure.
Figure 13:
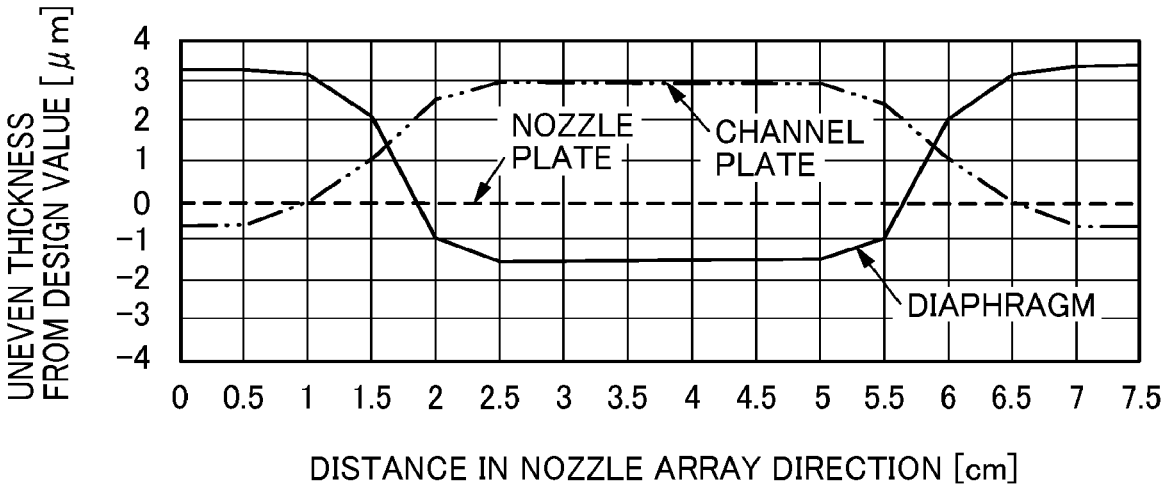
FIG. 13 is a graph of an example of an uneven thickness of the diaphragm in the nozzle array direction.
Figure 14:
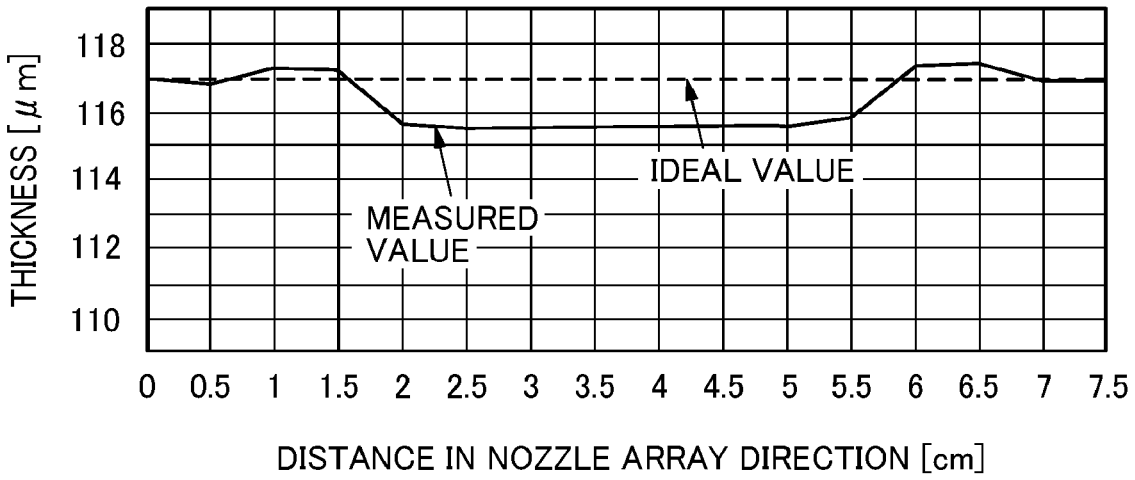
FIG. 14 is a graph of an example of an uneven thickness of the channel unit in the nozzle array direction.

Next, a second embodiment of the present disclosure is described with reference to FIGS. 12 to 14. FIG. 12 is a plan view of the diaphragm 3 according to the second embodiment. FIG. 13 is a graph of an example of an uneven thickness of the diaphragm 3 in the nozzle array direction NAD. FIG. 14 is a graph of an example of an uneven thickness of the channel unit 40 in the nozzle array direction NAD.

The diaphragm 3 includes concave portions 31 at both ends of the diaphragm 3 in the array direction of the pressure chambers 6 and does not include the concave portion 31 in the center of the diaphragm 3.

As illustrated in FIG. 13, in such a configuration, the diaphragm 3 has uneven thickness such that the thickness at both ends of the diaphragm 3 is thick and the thickness of the center of the diaphragm 3 is thin in the array direction of the pressure chambers 6.

Here, the entire nozzle plate 1 is flat, and the channel plate 2 has uneven thickness such that the thickness at both ends of the channel plate 2 is thin and the thickness at the center of the channel plate 2 is thick in the array direction of the pressure chambers 6.

Thus, as illustrated in FIG. 14, the thickness of the channel unit 40 formed by bonding the nozzle plate 1, the channel plate 2, and the diaphragm 3 becomes flat (even) within the range of 1 cm to 6.5 cm from one end of the channel unit 40.

Thus, the thickness of the diaphragm 3 is controlled according to uneven thickness of other components such as the nozzle plate 1 and the channel plate 2 to absorb uneven thickness of the other components. Thus, the flatness of the total thickness of the channel unit 40 as a whole can be improved. Further, reliability of bonding between the piezoelectric actuator 11 and the diaphragm 3 can be improved.

Figure 15:
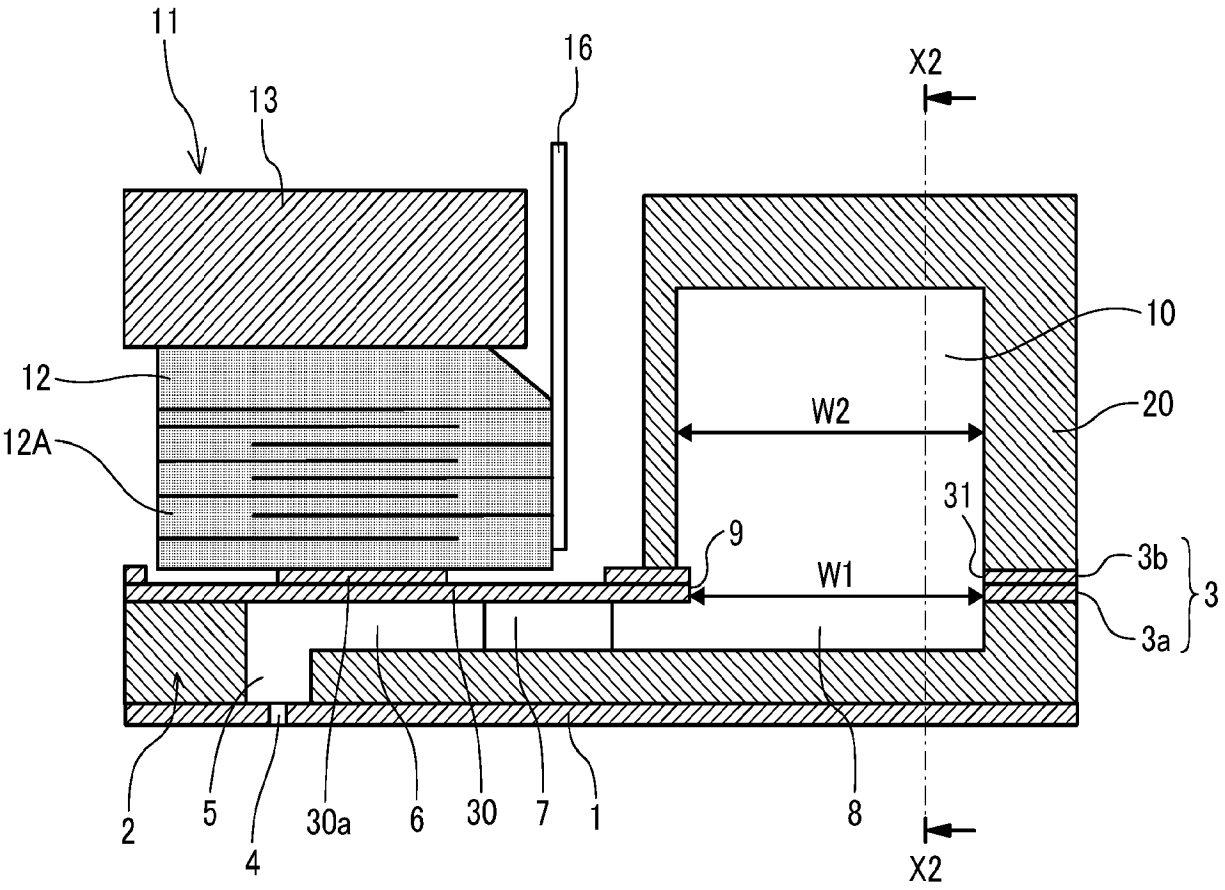
FIG. 15 is a cross-sectional view of the liquid discharge head according to a third embodiment of the present disclosure in a direction perpendicular to the nozzle array direction.
Figure 16:
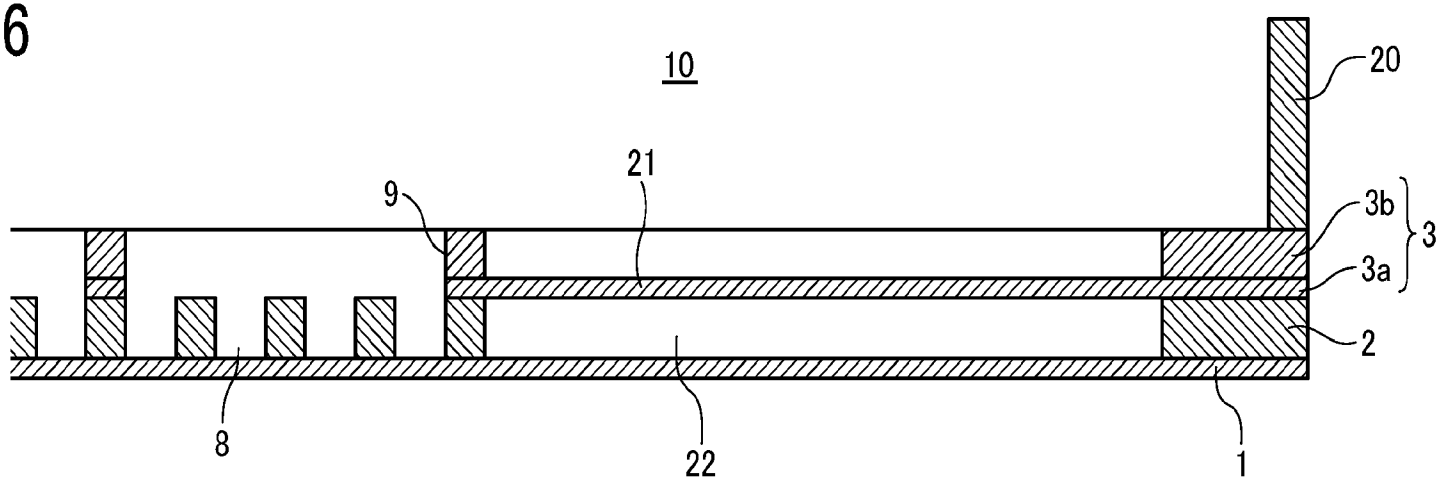
FIG. 16 is a schematic cross-sectional view along the nozzle array direction corresponding to a line X2-X2 in FIG. 15.
Figure 17:
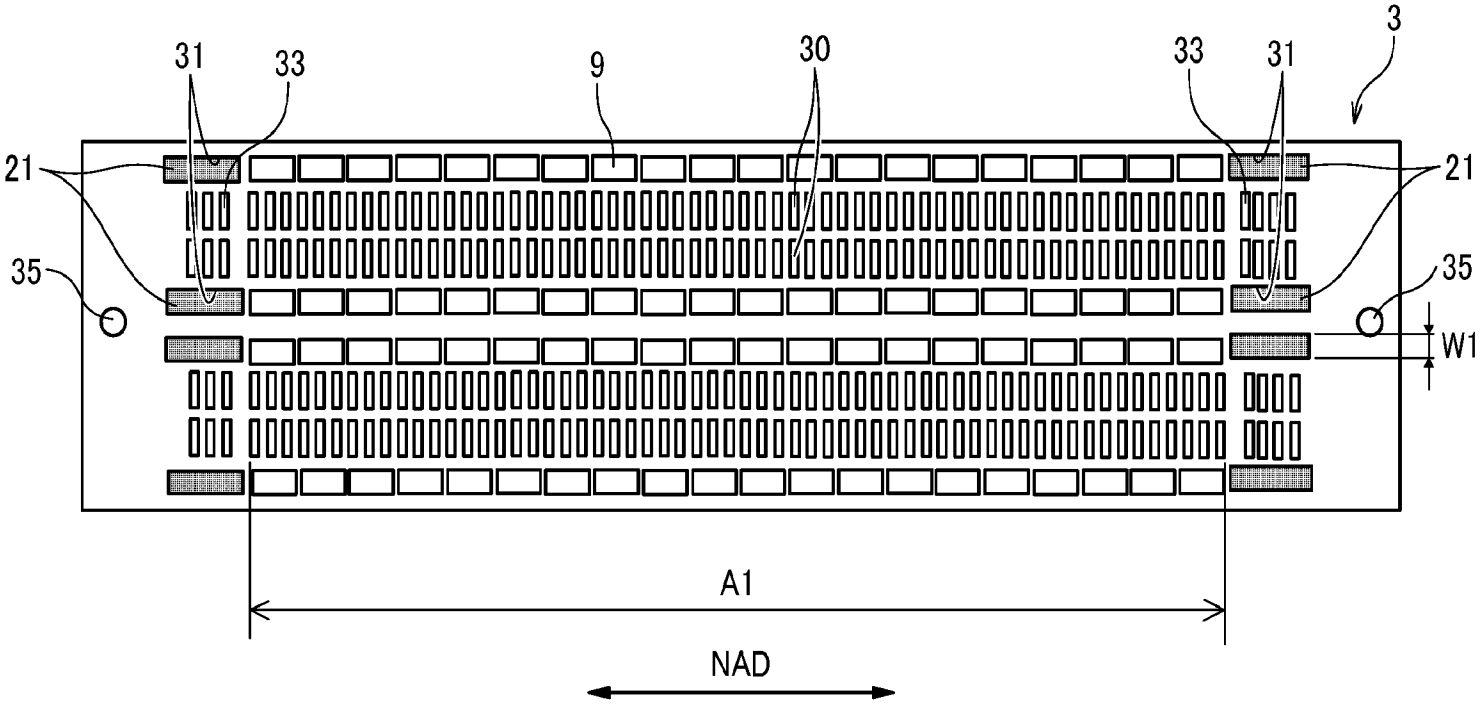
FIG. 17 is a plan view of the diaphragm of the liquid discharge head according to the third embodiment.
Figure 18:
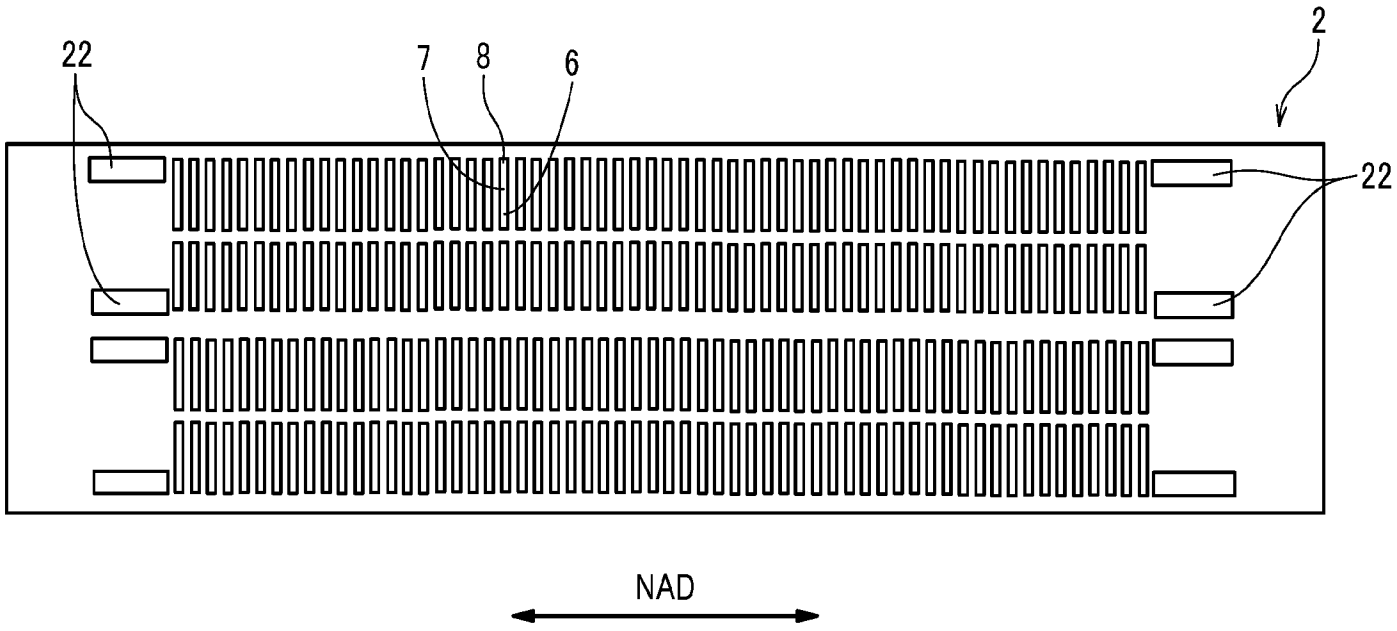
FIG. 18 is a plan view of the channel plate of the liquid discharge head according to the third embodiment.

Next, a third embodiment of the present disclosure is described with reference to FIGS. 15 to 18. FIG. 15 is a cross-sectional view of the head 100 according to a third embodiment of the present disclosure in a direction perpendicular to the nozzle array direction NAD. FIG. 16 is a schematic cross-sectional view along the nozzle array direction NAD corresponding to a line X2-X2 in FIG. 15. FIG. 17 is a plan view of the diaphragm 3. FIG. 18 is a plan view of the channel plate of the head 100.

As in the first embodiment, the diaphragm 3 according to the third embodiment includes a plurality of vibration portions 30 arranged in the arrangement region A1 of the pressure chamber 6 along the nozzle array direction NAD. Further, the diaphragm 3 according to the third embodiment includes a plurality of dummy vibration portions 33 outside the arrangement region A1 in the array direction of the pressure chambers 6. Further, the diaphragm 3 includes a plurality of openings 9 communicating with a plurality of the liquid introduction portions 8 in the arrangement region A1 of the pressure chamber 6. In the present disclosure, a width of the opening 9 in a direction perpendicular to the nozzle array direction NAD is substantially the same as a width of the common chamber 10.

The diaphragm 3 further includes concave portions 31 to form at least one damper 21 composed of a thin portion (first layer 3*a*) outside the arrangement region A1 of the pressure chamber 6 in the array direction of the pressure chambers 6. The damper chamber 22 is disposed on one side (lower side in FIG. 16) of the damper 21 opposite to the common chamber 10 disposed on another side (upper side in FIG. 16) of the damper 21. Further, the damper chamber 22 is disposed between the damper 21 and the nozzle plate 1. A through-hole of the channel plate 2 forms the damper chamber 22. The channel plate 2 is provided between the nozzle plate 1 and the diaphragm 3 (see FIG. 16).

As described above, the diaphragm 3 includes the concave portion 31 outside the arrangement region A1 of the pressure chamber 6 in the array direction of the pressure chambers 6. The concave portion 31 equalizes the film thickness of the diaphragm 3 and the channel unit 40. Further, the damper 21 facing the common chamber 10 is formed by the concave portions 31. Thus, fluctuation of pressure is attenuated, and a discharge characteristic of the head 100 is stabilized.

Figure 19:
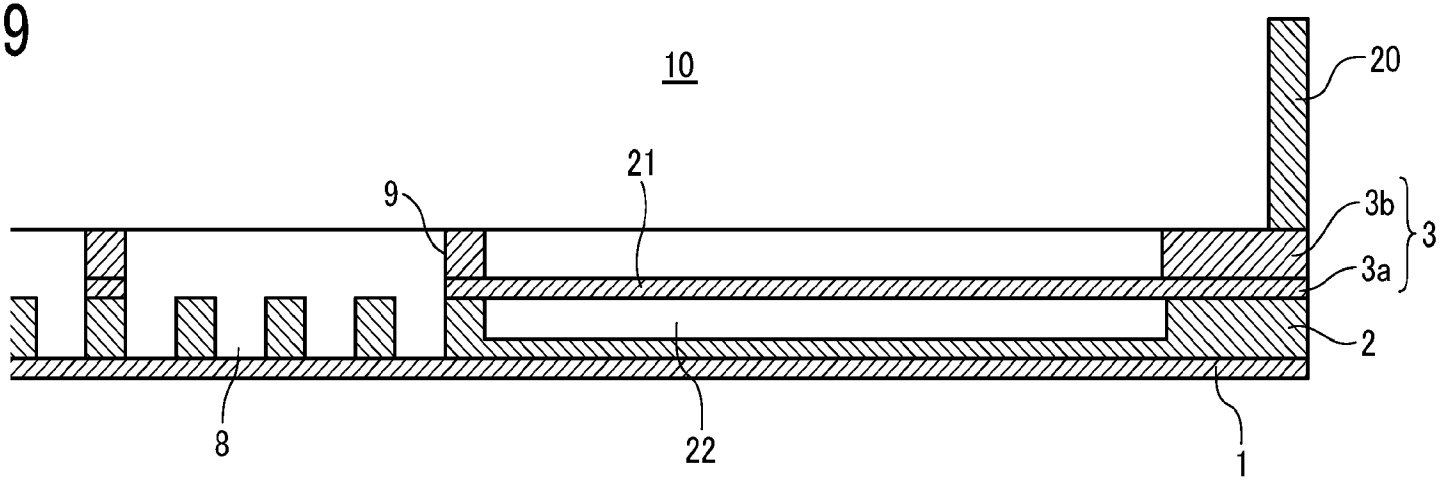
FIG. 19 is a cross-sectional view of the liquid discharge head according to a fourth embodiment along the nozzle array direction similar to FIG. 16.

Next, a fourth embodiment of the present disclosure is described below with reference to FIG. 19. FIG. 19 is a cross-sectional view of the head 100 according to the fourth embodiment along the nozzle array direction NAD similar to FIG. 16.

The head 100 in the present disclosure includes a damper chamber 22 formed by half-etching the channel plate 2. Other configurations of the head 100 are the same as the configurations of the head 100 in the third embodiment.

Figure 20:
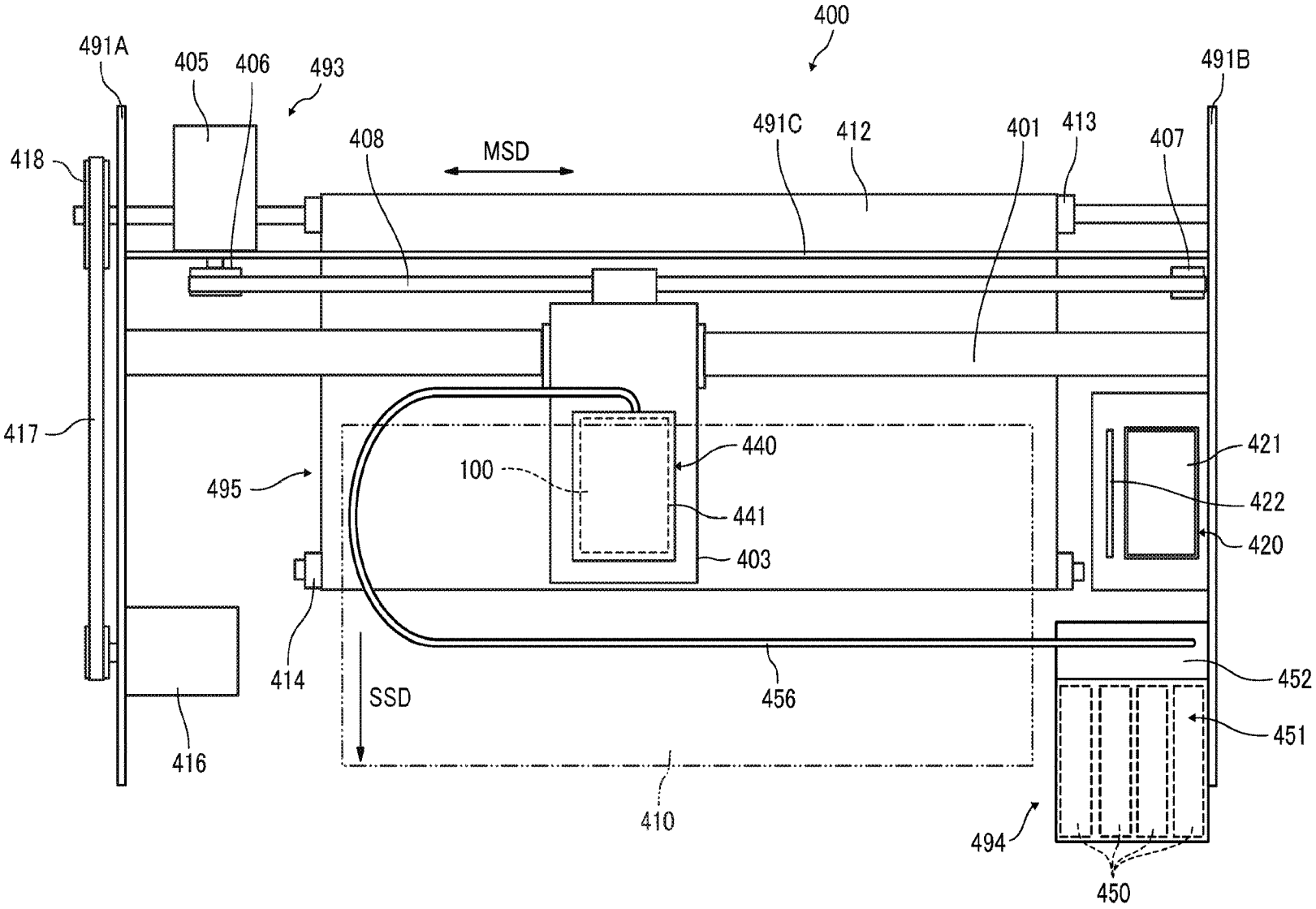
FIG. 20 is a plan view of a portion of a liquid discharge apparatus according to the present disclosure.
Figure 21:
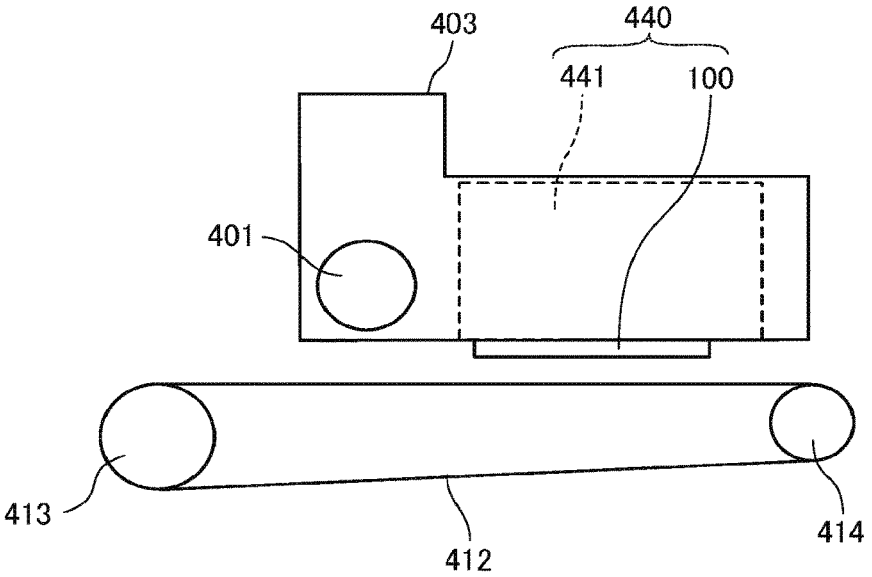
FIG. 21 is a side view of a portion of the liquid discharge apparatus of FIG. 20.

Next, a liquid discharge apparatus according to an embodiment of the present disclosure is described with reference to FIGS. 20 and 21. FIG. 20 is a plan view of a portion of the liquid discharge apparatus. FIG. 21 is a side view of a portion of the liquid discharge apparatus of FIG. 20.

A liquid discharge apparatus 400 according to the present disclosure is a serial-type apparatus in which a main scan moving unit 493 reciprocally moves a carriage 403 in a main scanning direction indicated by arrow MSD in FIG. 20. The main scan moving unit 493 includes a guide 401, a main scanning motor 405, and a timing belt 408, for example.

The guide 401 connects a left-side plate 491A and a right-side plate 491B that movably holds the carriage 403. The main scanning motor 405 reciprocally moves the carriage 403 in the main scanning direction MSD via the timing belt 408 entrained around a driving pulley 406 and a driven pulley 407.

The carriage 403 mounts a liquid discharge device 440. The head 100 according to the present disclosure and a head tank 441 forms the liquid discharge device 440 as a single unit. The head 100 of the liquid discharge device 440 discharges liquid of each color, for example, yellow (Y), cyan (C), magenta (M), and black (K). The head 100 includes nozzle arrays each including a plurality of nozzles 4 arrayed in row in a sub-scanning direction, which is indicated by arrow SSD in FIG. 20, perpendicular to the main scanning direction MSD. The head 100 is mounted to the carriage 403 so that liquid is discharged downward.

The liquid stored in liquid cartridges 450 are supplied to the head tank 441 by a supply unit 494 for supplying the liquid stored outside the head 100 to the head 100.

The supply unit 494 includes a cartridge holder 451 which is a filling section for mounting the liquid cartridges 450, a tube 456, a liquid feed unit 452 including a liquid feed pump, and the like. The liquid cartridges 450 are detachably attached to the cartridge holder 451. The liquid is supplied to the head tank 441 by the liquid feed unit 452 via the tube 456 from the liquid cartridges 450.

The liquid discharge apparatus 400 includes a conveyance unit 495 to convey a sheet 410. The conveyance unit 495 includes a conveyance belt 412 as a conveyance unit and a sub-scanning motor 416 to drive the conveyance belt 412.

The conveyance belt 412 attracts the sheet 410 and conveys the sheet 410 at a position facing the head 100. The conveyance belt 412 is an endless belt and is stretched between a conveyance roller 413 and a tension roller 414. Attraction of the sheet 410 to the conveyance belt 412 may be applied by electrostatic adsorption, air suction, or the like.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain the head 100 in good condition is disposed on a lateral side of the conveyance belt 412.

The maintenance unit 420 includes, for example, a cap 421 to cap a nozzle face of the head 100 and a wiper 422 to wipe the nozzle face. The nozzle face is a surface of the head 100 on which the nozzles 4 are formed as illustrated in FIG. 1.

The main scan moving unit 493, the supply unit 494, the maintenance unit 420, and the conveyance unit 495 are mounted to a housing that includes a left-side plate 491A, a right-side plate 491B, and a rear side plate 491C.

In the liquid discharge apparatus 400 thus configured, the sheet 410 is conveyed on and attracted to the conveyance belt 412 and is conveyed in the sub-scanning direction SSD by the cyclic rotation of the conveyance belt 412.

The head 100 is driven in response to image signals while the carriage 403 moves in the main scanning direction MSD, to discharge liquid to the sheet 410 stopped, thus forming an image on the sheet 410.

As described above, the liquid discharge apparatus 400 includes the head 100 according to the present disclosure, thus allowing stable formation of high-quality images.

Figure 22:
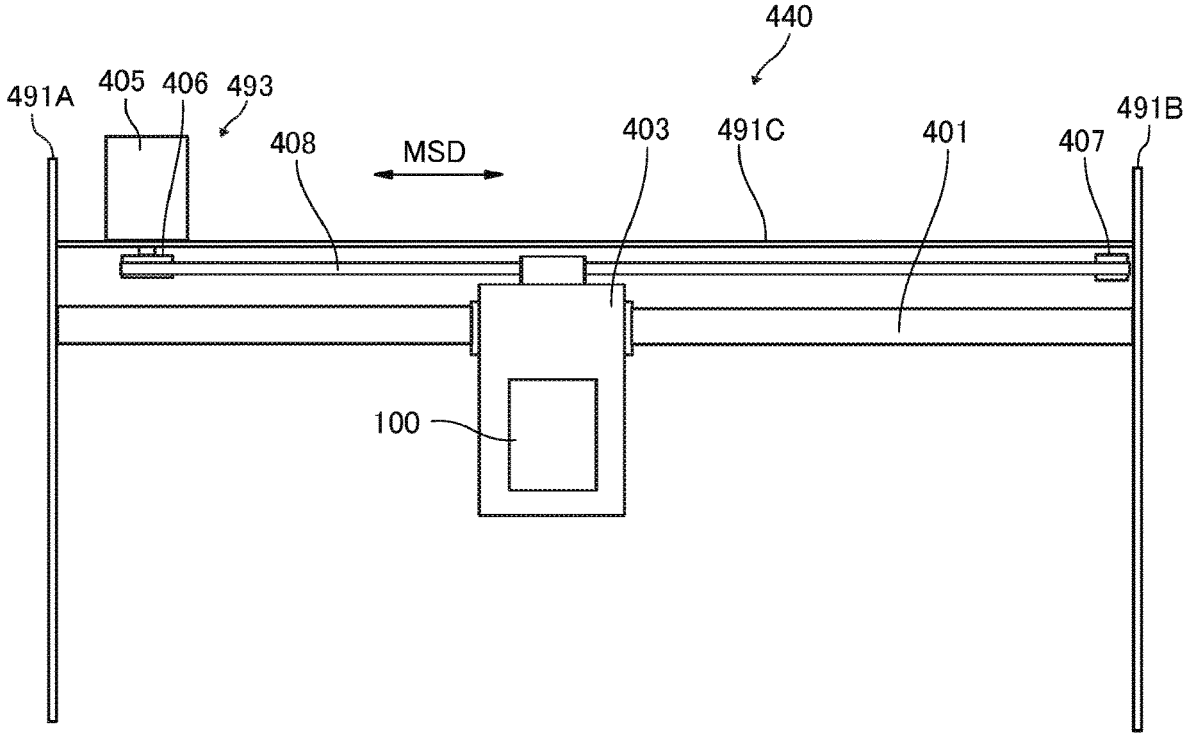
FIG. 22 is a plan view of a portion of another example of a liquid discharge device according to embodiments of the present disclosure.

Next, another example of the liquid discharge device 440 according to the present disclosure is described with reference to FIG. 22. FIG. 22 is a plan view of a portion of another example of the liquid discharge device 440.

The liquid discharge device 440 includes the housing, the main scan moving unit 493, the carriage 403, and the head 100 among components of the liquid discharge apparatus 400. The left-side plate 491A, the right-side plate 491B, and the rear side plate 491C forms the housing.

Note that, in the liquid discharge device 440, at least one of the maintenance unit 420 and the supply unit 494 described above may be mounted on, for example, the right-side plate 491B.

Figure 23:
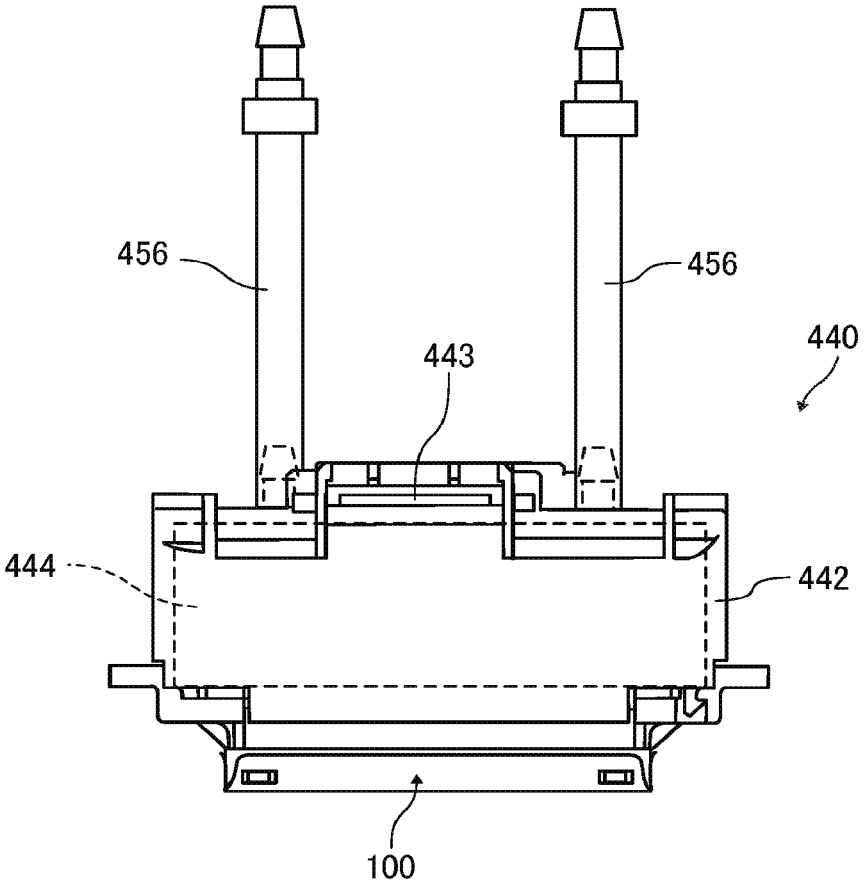
FIG. 23 is a front view of still another example of the liquid discharge device according to embodiments of the present disclosure.

Next, still another example of the liquid discharge device 440 according to the present disclosure is described with reference to FIG. 23. FIG. 23 is a front view of still another example of the liquid discharge device 440.

The liquid discharge device 440 includes the head 100 to which a channel part 444 is mounted and a tube 456 connected to the channel part 444.

Further, the channel part 444 is disposed inside a cover 442. Instead of the channel part 444, the liquid discharge device 440 may include the head tank 441. A connector 443 electrically connected with the head 100 is provided on an upper part of the channel part 444.

Further, "liquid" discharged from a liquid discharge head is not particularly limited as long as the liquid has a viscosity and surface tension of degrees dischargeable from the liquid discharge head. However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, suspension, or emulsion can be used for, e.g., inkjet ink, a surface treatment solution, a liquid for forming components of an electronic element or light-emitting element or a resist pattern of an electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the head and a functional part(s) or mechanism combined to the head to form a single unit. For example, the "liquid discharge device" includes a combination of the head with at least one of a head tank, a carriage, a supply unit, a maintenance unit, and a main scan moving unit.

Examples of the "single unit" include a combination in which the head and one or more functional parts and devices are secured to each other through, e.g., fastening, bonding, or engaging, and a combination in which one of the head and the functional parts and devices is movably held by another. The head may be detachably attached to the functional part(s) or unit(s) s each other.

For example, the head and the head tank may form the liquid discharge device as a single unit. Alternatively, the head and the head tank coupled (connected) with a tube or the like may form the liquid discharge device as a single unit. unit including a filter may further be added to a portion between the head tank and the head.

In another example, the liquid discharge device may include the head and the carriage to form a single unit.

In still another example, the liquid discharge device includes the head movably held by a guide that forms part of a main scan moving unit, so that the head and the main scan moving unit form a single unit. The liquid discharge device may include the head, the carriage, and the main scan moving unit that form a single unit.

In still another example, a cap that forms part of the maintenance unit is secured to the carriage mounting the head so that the head, the carriage, and the maintenance unit form a single unit to form the liquid discharge device.

Further, in still another example, the liquid discharge device includes tubes connected to the head tank or the head mounting a channel member so that the head and a supply unit form a single unit. Through this tube, the liquid in the liquid storage source such as an ink cartridge is supplied to the head.

The main scan moving unit may be a guide only. The supply unit may be a tube(s) only or a loading unit only.

The term "liquid discharge apparatus" used herein also represents an apparatus including the head or the liquid discharge device to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can be adhered" represents a material on which liquid is at least temporarily adhered, a material on which liquid is adhered and fixed, or a material into which liquid is adhered to permeate.

Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell.

The "material on which liquid can be adhered" includes any material on which liquid is adhered, unless particularly limited.

The above-mentioned "material onto which liquid can be adhered" may be any material as long as liquid can temporarily adhere such as paper, thread, fiber, cloth, leather, metal, plastic, glass, wood, ceramics, or the like.

The "liquid discharge apparatus" may be an apparatus to relatively move the head and a material on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat, with the treatment liquid, a sheet surface to reform the sheet surface and an injection granulation apparatus in which a composition liquid including raw materials dispersed in a solution is discharged through nozzles to granulate fine particles of the raw materials.

The terms "image formation", "recording", "printing", "image printing", and "fabricating" used herein may be used synonymously with each other.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A liquid discharge head, comprising:

a plurality of nozzles arrayed in a nozzle array direction to discharge a liquid;

a plurality of pressure chambers arrayed in the nozzle array direction and communicating with the plurality of nozzles, respectively, wherein an extent of the plurality of pressure chambers in the nozzle array direction defines an arrangement region; and a diaphragm forming a displaceable wall of each of the plurality of pressure chambers, the diaphragm including concave portions located outside both ends of the arrangement region in the nozzle array direction.

2. The liquid discharge head according to claim 1, further comprising a common chamber communicating with each of the plurality of pressure chambers, wherein the concave portion forms a damper that acts as a deformable wall of the common chamber.

3. The liquid discharge head according to claim 1, wherein the concave portion is formed in an area outside a center of the diaphragm in the nozzle array direction.

4. The liquid discharge head according to claim 1, wherein the diaphragm includes alignment marks in each end of the diaphragm in the nozzle array direction, and the concave portion is disposed between the alignment marks in the nozzle array direction.

5. A liquid discharge device comprising the liquid discharge head according to claim 1.

6. The liquid discharge device according to claim 5, wherein the liquid discharge head is integrated with at least one of:

a head tank to store the liquid to be supplied to the liquid discharge head, a carriage on which the liquid discharge head is mounted, a supply unit to supply the liquid to the liquid discharge head, a recovery device to maintain the liquid discharge head, and a main scan moving unit to move the liquid discharge head in a main scanning direction.

7. A liquid discharge apparatus comprising the liquid discharge device according to claim 5.

8. The liquid discharge head of claim 1, wherein the nozzle array direction extends in a longitudinal direction of the liquid discharge head, and the concave portions are located outside both ends of the arrangement region, which extends in the longitudinal direction.

* * * * *